US009758332B2

(12) United States Patent
Uruma et al.

(10) Patent No.: US 9,758,332 B2
(45) Date of Patent: Sep. 12, 2017

(54) ROLL-SHAPED MEDIUM TRANSPORT DEVICE, ROLL-SHAPED MEDIUM TRANSPORT METHOD, AND PRINTING APPARATUS

(75) Inventors: Hideo Uruma, Okaya (JP); Masaki Kobayashi, Matsumoto (JP); Kenji Hatada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 376 days.

(21) Appl. No.: 13/545,543

(22) Filed: Jul. 10, 2012

(65) Prior Publication Data

US 2013/0015285 A1 Jan. 17, 2013

(30) Foreign Application Priority Data

Jul. 13, 2011 (JP) ..... 2011-154509

(51) Int. Cl.
*B65H 18/10* (2006.01)
*B65H 20/00* (2006.01)
(Continued)

(52) U.S. Cl.
CPC ..... *B65H 18/103* (2013.01); *B41J 11/002* (2013.01); *B65H 20/005* (2013.01);
(Continued)

(58) Field of Classification Search
CPC .... B65H 18/103; B65H 20/02; B65H 20/005; B65H 2404/147; B65H 2511/52;
(Continued)

(56) References Cited

U.S. PATENT DOCUMENTS 4,994,851 A * 2/1991 Iwai ..... 355/50
5,178,341 A * 1/1993 Ditto ..... B65H 23/1806 242/412.2
(Continued)

FOREIGN PATENT DOCUMENTS

DE 19506463 8/1996
EP 0757299 2/1997
(Continued)

OTHER PUBLICATIONS

European Search Report dated Dec. 7, 2012 for European Patent Application No. 12175886.6.

*Primary Examiner* — William A Rivera
(74) *Attorney, Agent, or Firm* — Workman Nydegger

(57) ABSTRACT

A roll-shaped medium transport device includes: a medium supply unit that keeps a roll body formed by winding a roll-shaped medium on a support shaft, and unwinds and supplies the roll-shaped medium; a transport unit that transports the roll-shaped medium unwound from the roll body; a rotation detecting unit that detects rotation of the support shaft; a rotation unit that rotates the support shaft; and a determination unit that determines abnormality of a transport state of the roll-shaped medium on the basis of the rotation detecting unit when the rotation unit rotates the support shaft, when the rotation detecting unit does not detect the rotation of the support shaft in a state where a transport operation of the roll-shaped medium is performed by the transport unit.

5 Claims, 6 Drawing Sheets

(51) Int. Cl.
*B65H 20/02* (2006.01)
*B41J 11/00* (2006.01)

(52) U.S. Cl.
CPC ..... *B65H 20/02* (2013.01); *B65H 2301/415* (2013.01); *B65H 2404/147* (2013.01); *B65H 2511/52* (2013.01); *B65H 2513/11* (2013.01); *B65H 2513/40* (2013.01); *B65H 2553/51* (2013.01); *B65H 2601/10* (2013.01); *B65H 2601/273* (2013.01); *B65H 2801/12* (2013.01)

(58) Field of Classification Search
CPC ..... B65H 2301/415; B65H 2513/40; B65H 2553/51; B65H 2601/10; B65H 2601/273; B65H 2801/12; B65H 2513/11; B41J 11/002
USPC ..... 242/534–534.2, 563, 563.2, 420, 420.5, 242/419, 419.8, 413–413.5, 413.9
See application file for complete search history.

(56) References Cited

U.S. PATENT DOCUMENTS 5,345,863 A * 9/1994 Kurata ..... B41J 2/21 101/126
5,632,454 A * 5/1997 Murakami ..... G03B 27/6285 242/528
5,653,402 A * 8/1997 Nakano ..... G03B 27/587 242/563
5,708,911 A * 1/1998 Kageyama et al. ..... 399/23
5,775,627 A * 7/1998 Murakami ..... G03D 13/003 242/526
5,796,221 A 8/1998 Cramer et al.
5,825,374 A * 10/1998 Albertalli ..... B41J 11/0085 226/156
5,839,046 A * 11/1998 Takano ..... B41J 11/002 399/118
6,091,928 A * 7/2000 Fuchisawa ..... B41J 11/006 399/384
6,112,655 A * 9/2000 Suzuki ..... B41L 21/02 101/118
6,612,517 B1 * 9/2003 Nakamura ..... G11B 15/48 242/413
6,650,077 B1 * 11/2003 Marra et al. ..... 318/560
6,693,655 B2 * 2/2004 Fujimoto ..... B41J 2/32 347/213
7,168,652 B2 * 1/2007 Tokunaga ..... 242/563
8,517,620 B2 * 8/2013 Kanbara ..... B41J 11/001 242/417.3
8,857,976 B2 * 10/2014 Nakada ..... B41J 11/0075 347/104
2008/0073832 A1 3/2008 Sudo et al.
2008/0131185 A1 * 6/2008 Kim ..... 400/605
2008/0239052 A1 * 10/2008 Ishii et al. ..... 347/104
2009/0226235 A1 * 9/2009 Kobayashi ..... B41J 15/04 400/614
2009/0269119 A1 * 10/2009 Hatada et al. ..... 400/618
2011/0242245 A1 * 10/2011 Okazaki ..... B41J 11/0085 347/104
2012/0203497 A1 * 8/2012 Yamane ..... B65H 43/00 702/145
2013/0042807 A1 * 2/2013 Noguchi ..... B65H 18/10 118/500
2014/0078209 A1 * 3/2014 Matsuoka ..... B41J 11/0095 347/16
2014/0151491 A1 * 6/2014 Mizutani ..... B65H 26/063 242/563
2015/0328909 A1 * 11/2015 Takizawa ..... B41J 13/0009 347/104

FOREIGN PATENT DOCUMENTS

JP 8127119 5/1996
JP 3527016 2/2004
JP 2004-167931 6/2004
JP 2008-254826 10/2008
JP 2009-269713 11/2009

* cited by examiner

ROLL-SHAPED MEDIUM TRANSPORT DEVICE, ROLL-SHAPED MEDIUM TRANSPORT METHOD, AND PRINTING APPARATUS

BACKGROUND

1. Technical Field

The present invention relates to a roll-shaped medium transport device, a roll-shaped medium transport method, and a printing apparatus.

2. Related Art

In the related art, as a medium transport device, a device is known in which a roll sheet unwound from a roll body (a roll-shaped medium) formed by winding a roll sheet on a shaft member is supplied to an image forming apparatus (for example, see Japanese Patent No. 03527016). The roll sheet of the roll body is wound out to the end, and the sheet end deviates from the shaft member.

However, in the roll body described above, for example, the shaft member and the sheet end of the roll sheet may be bonded by an external environment. In this case, in the related art, there is a problem that the roll sheet is not transported normally, and an image is not satisfactorily formed by an image forming apparatus.

SUMMARY

An advantage of some aspects of the invention is to provide a roll-shaped medium transport device, a roll-shaped medium transport method, and a printing apparatus, capable of reliably detecting a transport fault of the roll-shaped medium.

According to an aspect of the invention, there is provided a roll-shaped medium transport device including: a medium supply unit that keeps a roll body formed by winding a roll-shaped medium on a support shaft, and unwinds and supplies the roll-shaped medium; a transport unit that transports the roll-shaped medium unwound from the roll body; a rotation detecting unit that detects rotation of the support shaft; a rotation unit that rotates the support shaft; and a determination unit that determines abnormality of a transport state of the roll-shaped medium on the basis of the detection result of the rotation detecting unit when the rotation unit rotates the support shaft, when the rotation detecting unit does not detect the rotation of the support shaft in a state where a transport operation of the roll-shaped medium is performed by the transport unit.

For example, when the roll-shaped medium is attached to the support shaft, the rotation of the support shaft caused by the rotation unit is not detected by the rotation detecting unit. As described above, when the roll-shaped medium is attached to the support shaft, it is difficult to transport the roll-shaped medium satisfactorily. That is, the determination unit may determine the transport state of the roll-shaped medium on the basis of the detection result of the rotation detection unit.

As described above, according to the roll-shaped medium transport device, the determination unit is provided, and thus it is possible to detect abnormality of the transport state of the roll-shaped medium.

In the roll-shaped medium transport device, the determination unit may determine that the transport state of the roll-shaped medium is normal when the rotation of the support shaft is detected by the rotation detecting unit.

When the roll-shaped medium is not attached to the support shaft and the roll-shaped medium is separated from the support shaft, the rotation of the support shaft caused by the rotation unit is detected by the rotation detecting unit. In this case, the roll-shaped medium is satisfactorily transported.

According to the aspect of the invention, the determination unit may reliably determine the state where the roll-shaped medium is not attached to the support shaft and the roll-shaped medium is separated from the support shaft, that is, the transport state of the roll-shaped medium is normal.

In the roll-shaped medium transport device, the rotation unit may rotate the support shaft in a direction opposite to a transport direction of the roll-shaped medium.

With such a configuration, the support shaft is rotated in the direction opposite to the transport direction, that is, in a winding direction of the roll-shaped medium, and thus it is possible to determine whether or not the support shaft is momentarily rotated. Accordingly, it is possible to satisfactorily detect the attachment of the roll-shaped medium to the support shaft on the basis of the rotation detection of the support shaft.

The roll-shaped medium transport device may further includes an end detecting unit that is disposed between the medium supply unit and the transport unit and detects an end of the roll-shaped medium, wherein the determination unit determines that the roll-shaped medium of the roll body is ended when the end detecting unit detects the end of the roll-shaped medium, when the rotation of the support shaft is detected by the rotation detecting unit.

With such a configuration, the determination unit may satisfactorily determine the state where the roll-shaped medium wound on the support shaft disappears.

According to another aspect of the invention, there is provided a roll-shaped medium transport method of transporting a roll-shaped medium wound out from a roll body formed by winding the roll-shaped medium on a support shaft, the method including: determining a transport state of the roll-shaped medium, wherein the determining includes rotating the support shaft using a rotation unit when rotation of the support shaft is not detected in a state where a transport operation of the roll-shaped medium is performed, detecting the rotation of the support shaft caused by the rotation unit, and determining abnormality of the transport state on the basis of the detection result of the detection.

According to the roll-shaped medium transport method of the aspect of the invention, the transport state of the roll-shaped medium is determined on the basis of the detection result of the rotation detecting unit, and it is possible to detect abnormality of the transport state of the roll-shaped medium caused by the attachment.

According to still another aspect of the invention, there is provided a printing apparatus including: the roll-shaped medium transport device; and a printing unit that performs a printing process on the roll-shaped medium supplied to the roll-shaped medium transport device, wherein the transport of the roll-shaped medium and the printing process performed by the printing unit are stopped when the determination unit determines that the transport state of the roll-shaped medium is abnormal.

According to the printing apparatus, when it is determined that the transport state of the roll-shaped medium is abnormal, it is possible to stop the transport of the roll-shaped medium. Accordingly, it is possible to prevent a defect from occurring, that is, the printing process is performed on a roll-shaped medium which is not satisfactorily transported to the printing unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
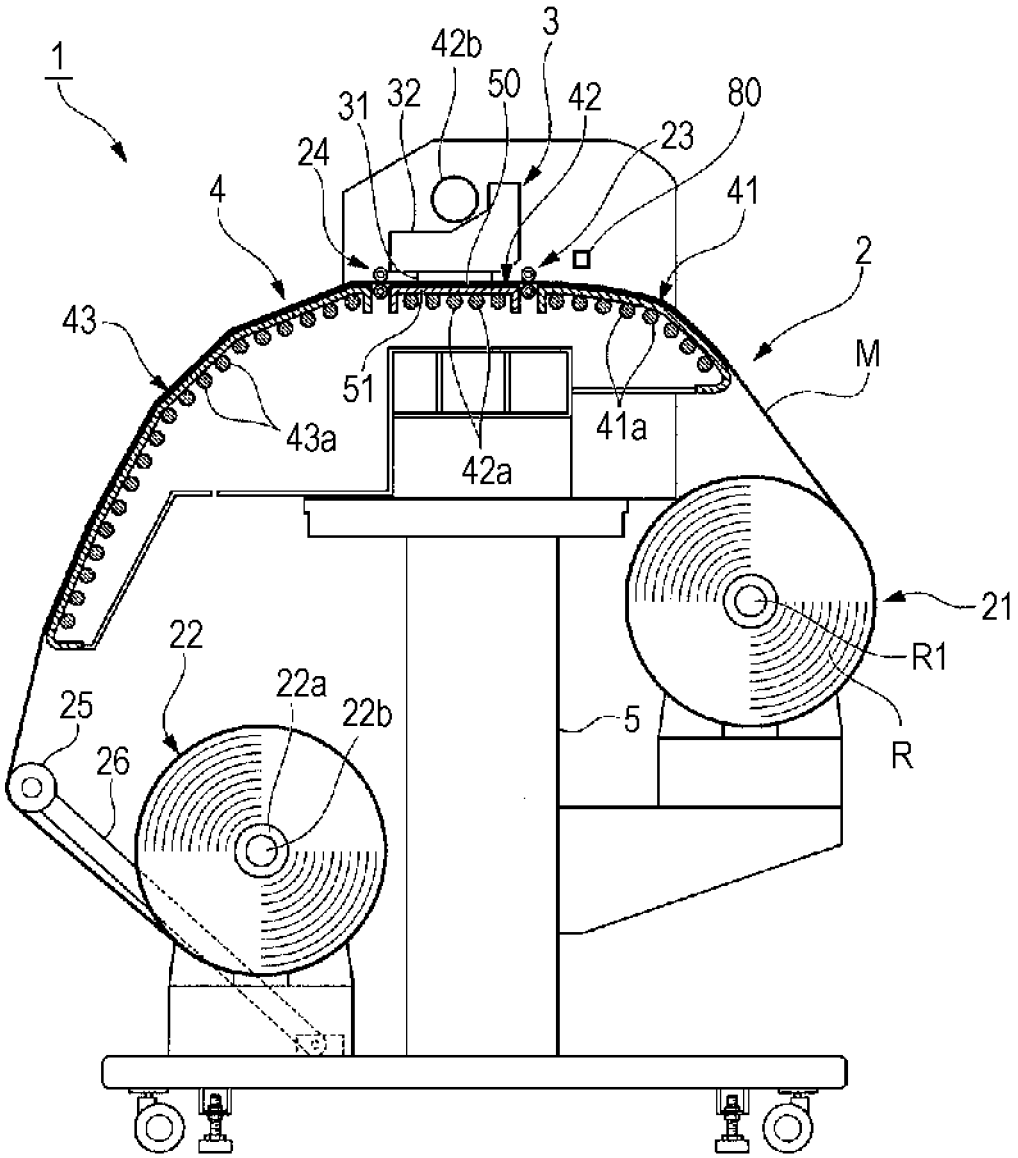
FIG. 1 is a diagram illustrating a configuration of a printer according to an embodiment.

Hereinafter, embodiments of a printing apparatus according to the invention will be described with reference to the drawings. In the drawings used in the following description, to make members recognizable sizes, scales of the members are appropriately modified. In the embodiment, an ink jet printer (hereinafter, merely referred to as a printer) is exemplified as the printing apparatus according to the invention.

FIG. 1 is a diagram illustrating a configuration of a printer 1 according to an embodiment of the invention.

The printer 1 is a large format printer (LFP) that handles a relatively large medium (printing medium) M. In the embodiment, the medium is formed of a vinyl-chloride-based film having a width of, for example, about 64 inches.

As shown in FIG. 1, the printer 1 includes a transport unit (a roll-shaped medium transport device) 2 that transports the medium M in a roll-to-roll manner, a printing unit 3 that ejects ink (fluid) onto the medium M to print an image or characters, a heating unit 4 that heats the medium M, and a control unit 40 (see FIG. 3) that controls the whole printer 1 in addition to driving of the transport unit 2, the printing unit 3, and the heating unit 4. The constituent units are supported by a body frame 5.

The transport unit 2 includes a sending-out unit (a medium supply unit) 21 that sends the roll-shaped medium M from the roll body R, and a winding unit 22 that winds out the sent medium M. The transport unit 2 includes a transport roller pair (transport means) 23 and 24 that transport the medium M on a transport path between the sending-out unit 21 and the winding unit 22. The transport unit 2 includes a tension roller 25 that applies tension to the medium M on the transport path between the transport roller pair 24 and the winding unit 22. The transport unit 2 includes an end detecting sensor (end detecting means) 80 that detects an end of the medium M. The end detecting sensor 80 is electrically connected to the control unit 30, and transmits the detection signal.

The sending-out unit 21 keeps the roll body R formed of the medium M wound on a support shaft R1, and unwinds the medium M to supply the medium M to the printing unit 3. Meanwhile, the winding unit 22, to which a transport force of a main driving roller is applied, sequentially winds out the medium M unwound from the sending-out unit 21 and subjected to a predetermined printing process by the printing unit 3.

Figure 2:
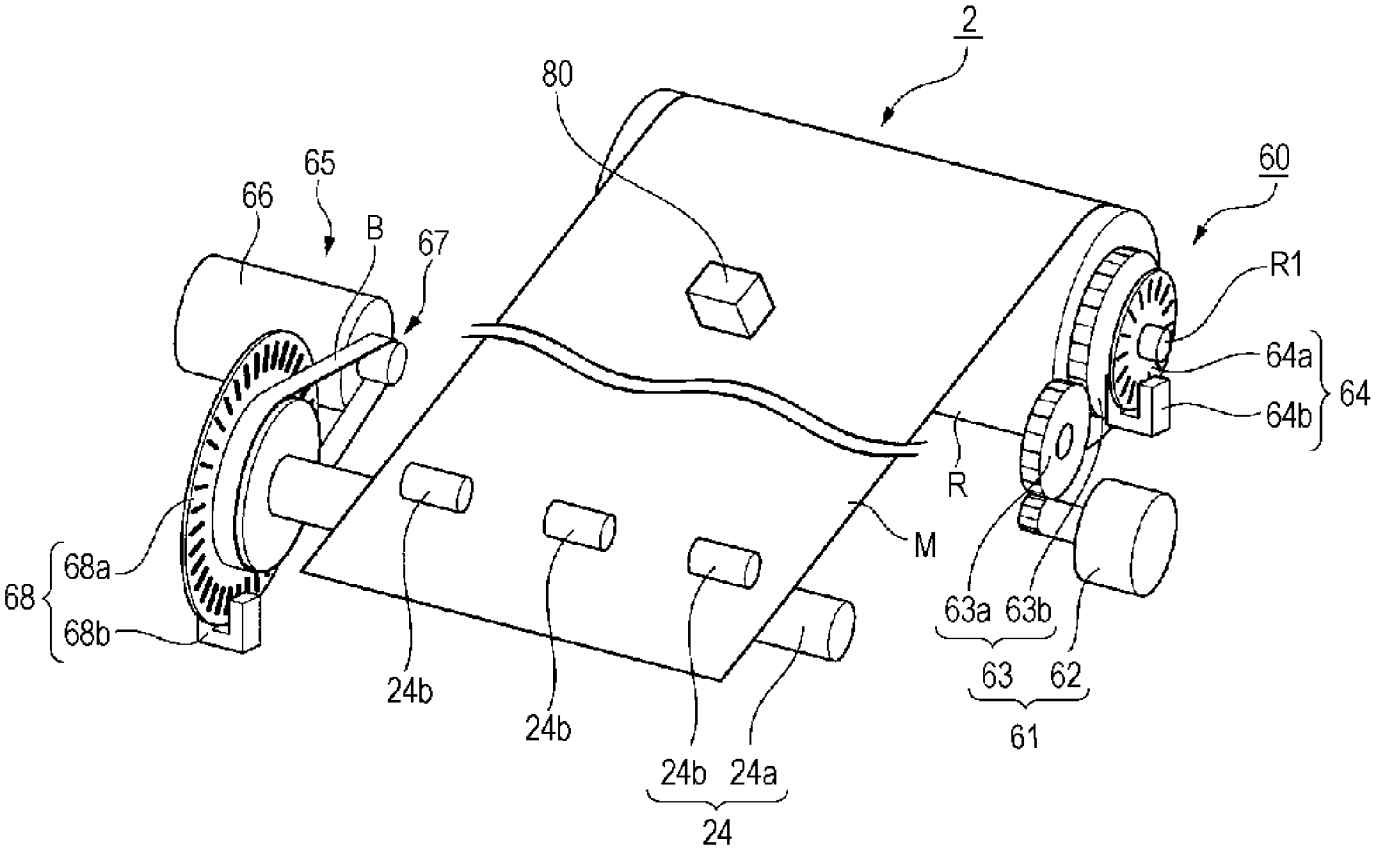
FIG. 2 is a diagram illustrating a configuration of a main part of a transport unit according to the embodiment.

FIG. 2 is a diagram illustrating a configuration of a main part of the transport unit 2. As shown in FIG. 2, the sending-out unit 21 includes a detection device (rotation detecting means) 60 that detects rotation of the support shaft R1 of the roll body R. The detecting device 60 includes a roll rotation detecting unit 64 that detects the amount of rotation of the support shaft R1 on which the medium is wound, that is, the roll body R, and a roll driving unit 61 that applies a rotational movement force to the roll body R. The roll driving unit 61 is electrically connected to the control unit 40, and the driving thereof is controlled (see FIG. 3)

The roll driving unit 61 is provided with a dynamic force transferring mechanism 63 that transfers the dynamic force of a motor 62 to the roll body R, and rotates the roll body R in a forward rotation direction (a direction of unwinding the medium M) or a reverse rotation direction (a direction of winding the medium M) by rotation of the motor 62. The dynamic force transferring mechanism 63 includes a first gear 63*a* engaging with a rotation shaft of the motor 62, and a second gear 63*b* integrally mounted on the support shaft R1. The dynamic transferring mechanism 63 may be provided with a planetary gear mechanism (not shown) to transfer the dynamic force of the motor 62 to the roll body R only in the reverse rotation direction.

The roll rotation detecting unit 64 includes a disc-shaped scale 64*a* having a plurality of light transmission units (now shown) at the outer peripheral portion thereof, and a detection unit 64*b* that includes a light emitting unit that emits light to the light transmission unit and a light receiving unit that receives the light passing through the light transmission unit. The disc-shaped scale 64*a* is integrally provided with the support shaft R1 of the roll body R. The roll rotation detecting unit 64 is electrically connected to the control unit 40, and the detection signal of the detecting unit 64*b* is transmitted thereto (see FIG. 3).

When the disc-shaped scale 64*a* is rotated according to the rotation of the support shaft R1, the detection unit 64*b* outputs a rising signal and a falling signal formed by the light passing through the light transmission unit, the control unit 40 receives the output signals from the detection unit 34*b* described above, and thus it is possible to calculate a rotation amount (a rotation angle) or a rotation speed of the roll body R (the support shaft R1) per unit time.

The transport roller pair 24 includes a main driving roller 24*a*, and a driven roller 24*b* that is driven by the rotation of the main driving roller 24*a*. The transport roller pair 23 is formed of a pair of rollers pinching the medium M therebetween, and each of which is driven by the medium M transported by the main driving roller 24*a*.

As shown in FIG. 2, the transport unit 2 includes a roller rotation detecting unit 68 that detects the rotation amount of the main driving roller 24*a* transporting the medium M by coming in contact with the medium M unwound from the roll body R and rotating, a driving unit 65 that applies a rotation movement force to the main driving roller 24*a*. The driving unit 65 and the rotation detecting unit 68 are electrically connected to the control unit 40, and the driving thereof is controlled (see FIG. 3).

The driving unit 65 includes a motor 66, a dynamic force transferring mechanism 67 that transfers the dynamic force of the motor 66 to the main driving roller 24*a* to rotate the main driving roller 24*a* in a forward rotation direction (a direction of transporting the medium M unwound from the roll body R) or a reverse rotation direction (a direction of sending the medium in the winding direction of the roll body R). The dynamic force transferring mechanism 67 includes a belt B passing over between one end of the shaft portion of the main driving roller and the rotation shaft of the motor 66.

Roller rotation detecting unit 68 includes a plurality of light transmission units (not shown) at the outer peripheral portion, a disc-shaped scale 68*a* mounted at the shaft end of the main driving roller 24*a*, and a detection unit 68*b* provided with a light emitting unit emitting light to the light transmission units and a light receiving unit receiving light passing through the transmission units.

When the disc-shaped scale 68*a* is rotated according to the rotation of the main driving roller, the detection unit 68*b* outputs a rising signal and a falling signal formed by the light passing through the light transmission units, the control unit 40 receives the output signals from the detection unit 68*b* described above, and thus it is possible to calculate a rotation amount (a rotation angle) or a rotation speed of main driving roller per unit time.

The winding unit 22 includes a winding shaft 22*a* for winding the medium M, and a motor 22*b* that rotates the winding shaft 22*a* in the winding direction (a transport direction of the medium M). The motor 22*b* is electrically connected to the control unit 40, and the driving thereof is controlled.

When the control unit 40 drives the driving unit 65 such that the transport unit 2 rotates the main driving roller 24*a* in the forward rotation direction, the roll body R is rotated with the support shaft R1. Accordingly, the medium M is unwound from the kept roll body R of the sending-out unit 21, and is transported under the printing unit 3. The transport unit 2 drives the motor 22*b* according to the driving of the driving unit 65 to rotate the winding shaft 22*a* in the forward rotation direction, and thus it is possible to wind the medium M subjected to the printing process performed by the printing unit 3.

The control unit 40 receives the output signal of the disc-shaped scale 68*a* rotated according to the rotation of the main driving roller 24*a* from the detection unit 68*b* to calculate a transport amount of the medium M transported by the main driving roller 24*a*. Accordingly, the control unit 40 controls the transport amount of the medium M satisfactorily.

In the embodiment, the control unit 40 detects the transport amount of the medium M, and receives the output signal of the disc-shaped scale 64*a* mounted on the support shaft R1 rotated in the forward rotation direction according to the rotation of the roll body R to detect the rotation of the roll body R. Accordingly, the control unit 40 serves as a determination unit that determines abnormality of the transport state of the medium M to be described later.

As shown in FIG. 1, the tension roller 25 is supported by a fluctuation frame 26, and has a configuration of coming in contact with a back face of the medium M in a width direction (a sheet vertical direction in FIG. 1). The tension roller 25 is formed more long in the width direction than the width of the medium M. The tension roller 25 is provided on the downstream side in transport direction of an after-heater 43 of the heating unit 4.

The printing unit 3 includes an ink jet head 31 that ejects ink (fluid) to the medium M on the transport path between the transport roller pair 23 and 24, and a carriage 32 that mounts an ink jet head 31 and freely moves back and forth. The ink jet head 31 is provided with a plurality of nozzles, is selected from the relationship with the medium M, and ejects ink which requires infiltration drying or evaporation drying. The printing unit 3 is electrically connected to the control unit 40, and the driving thereof is controlled (see FIG. 3). When abnormality of the transport state of the medium M is determined (described later), the control unit 40 stops the printing process performed by the printing unit 3.

The heating unit 4 heats the medium M to rapidly dry and fix the ink to the medium M by heating the medium M, and prevents bleeding and blur, to improve image quality. The heating unit 4 has a support face constituting a part of the transport path of the medium M, bends the medium M to be concave upward between the sending-out unit 21 and the winding unit 22, and heats the medium M of the support face. The heating unit 4 is electrically connected to the control unit 40, and driving thereof is controlled (see FIG. 3).

The heating unit 4 includes a pre-heater unit 41 that preheats the medium M on the upstream side in the transport direction from the position where the printing unit 3 is provided, a platen heater unit 42 that heats the medium M at a position opposed to the printing unit 3, and an after-heater unit 43 that heats the medium M on the downstream side in the transport direction from the position where the printing unit 3 is provided.

In the embodiment, a heating temperature of the heater 41*a* in the pre-heater unit 41 is set to 40° C. In the embodiment, a heating temperature of the heater 42*a* in the plate heater unit 42 is set to 40° C. (a target temperature) similarly to the heater 41*a*. In the embodiment, a heating temperature of the heater 43*a* in the after-heater unit 43 is set to 50° C. higher than that of the heaters 41*a* and 42*a*.

The pre-heater unit 41 gradually raises the temperature of the medium M from the normal temperature to the target temperature (the temperature in the platen heater unit 42), thereby rapidly promoting drying from the time the ink lands. The platen heater unit 42 causes the landing of the ink to be performed on the medium M in a state of keeping the target temperature to rapidly promote the drying of the ink from the time of landing of the ink.

The after-heater unit 43 raises the temperature of the medium M to a temperature higher than the target temperature, rapidly dries at least non-dried ink of the ink landing on the medium M, and completely dries and at least fixes the landing ink to the medium M before winding the medium by the winding unit 22.

Figure 3:
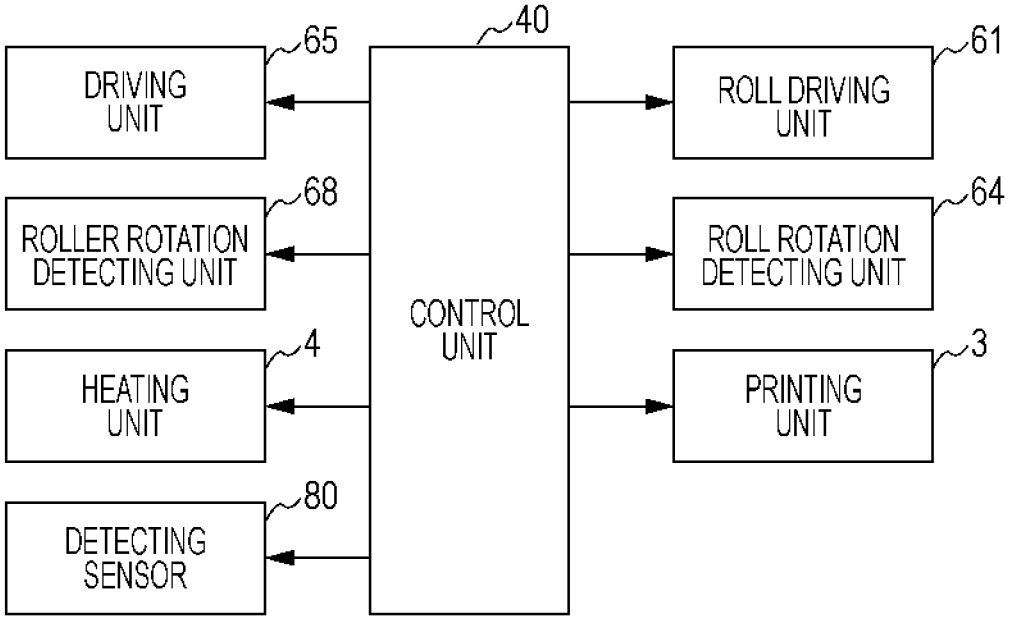
FIG. 3 is a block diagram illustrating an electrical configuration of the printer according to the embodiment.

FIG. 3 is a block diagram illustrating an electrical configuration of the printer 1. As shown in FIG. 3, the printer 1 includes the control unit 40 that controls the driving of each constituent member (the printing unit 3, the heating unit 4, the roll driving unit 61, the roll rotation detecting unit 64, the driving unit 65, and the roller rotation detecting unit 68).

Figure 4:
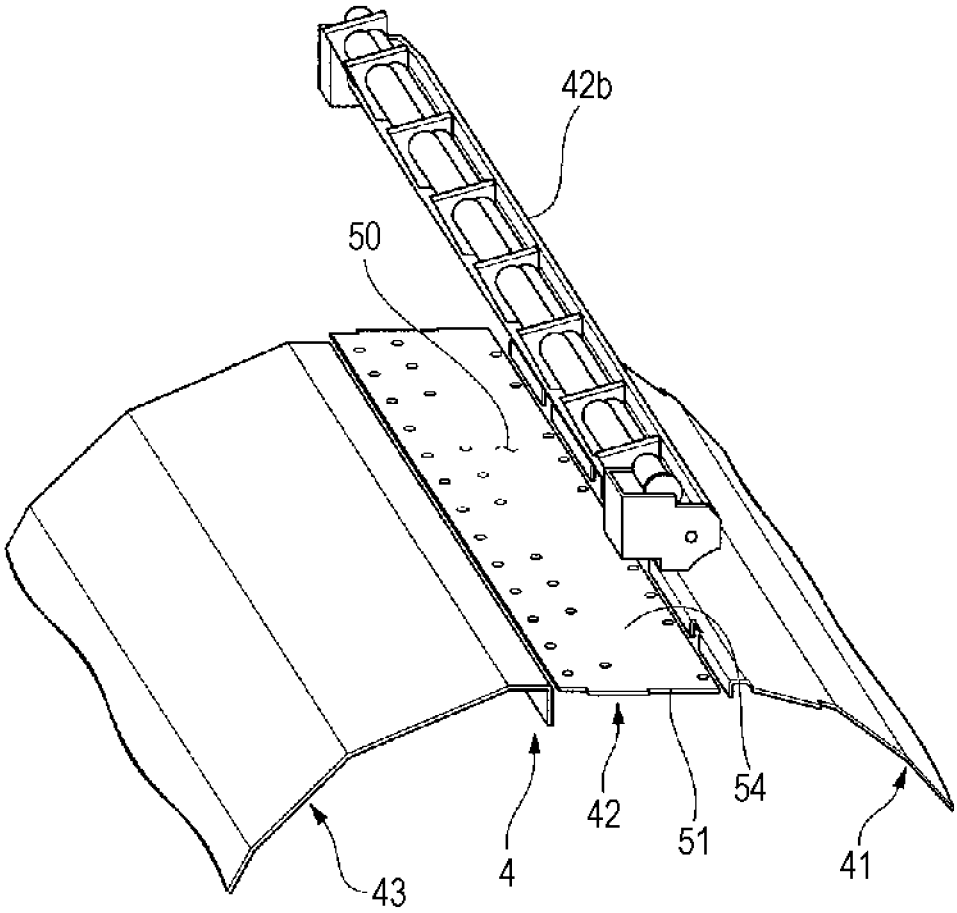
FIG. 4 is a perspective view illustrating a configuration of a platen heater according to the embodiment.
Figure 5:
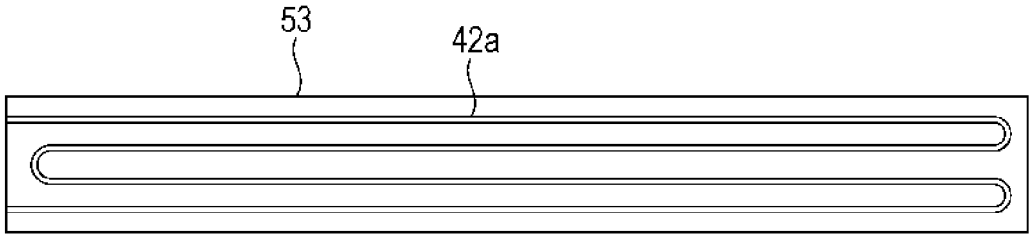
FIG. 5 is a plan view illustrating a configuration of a heater according to the embodiment.

Subsequently, characteristic configurations in the platen heater unit 42 in the embodiment will be described with reference to FIG. 4 and FIG. 5. FIG. 4 is a perspective view illustrating a configuration of the platen heater unit 42 in the embodiment of the invention. FIG. 5 is a plan view illustrating a configuration of the heater 42*a* in the embodiment of the invention.

As shown in FIG. 4, the platen heater unit 42 includes a platen (support member) 51 having a support face supporting the medium M. The platen 41 is formed of a metal material such as an Al material or a SUS material. The platen 51 of the embodiment is formed of the Al material. The platen 51 is longer than the width of the medium M in the width direction, and more specifically, has a flat plate shape longer than about 64 inches.

On a face opposite to the support face 50 of the platen 51, the heater 42*a* shown in FIG. 5 is wired. The heater 42*a* is a tube heater, and is attached to the opposite face to the plate 51 through an aluminum tape 53. Accordingly, the heater 42*a* transfers heat and heats the platen 51 by heat conduction from the opposite face, and indirectly heats the medium M supported on the support face 50 from the rear side.

At a position opposed to the support face 50 of the platen 51, a heater 42*b* (a radiation heating unit) shown in FIG. 1 is provided. The heater 42*b* is an infrared heater, and is provided to extend over the width direction of the platen 51 at a predetermined distance from the support face 50. Accordingly, the heater 42*b* directly irradiates the support face 50 with infrared energy to radiate and heat the platen 51. When the medium M is supported on the support face 50, the heater 42*b* directly radiates and heats the printing face side of the medium M.

The heater 42*b* irradiates an electromagnetic wave having a wavelength in which a main part of a peak of a radiation spectrum includes an area of 2 μm to 4 μm. Accordingly, the heater 42*b* does not raise the temperature of the constituent members, which does not includes peripheral water molecules, so much, and vibrates the water molecules included in the ink to rapidly promote the drying by friction heat thereof. Accordingly, most of the infrared energy is absorbed by the ink, and it is possible to more intensively heat the ink landing on the printing face than the medium M.

At a position opposed to the support face 50, the ink jet head 31 shown in FIG. 1 is provided. The ink jet head 31 has a positional relationship of being positioned between the support face 50 and the heater 42*b*, and is mounted on the carriage 32 to reciprocate in the width direction therebetween. Accordingly, the nozzle plate that is the ink ejecting unit of the ink jet head 31 is not irradiated with the infrared energy, and thus it is possible to prevent the ink from being solid and fixed at the nozzle part. The carriage 32 is irradiated with the infrared energy, and thus the carriage 32 is provided with, for example, a heat insulating material or the like, as a thermal countermeasure.

Subsequently, an operation of the printer 1 according to the embodiment will be described.

When a printing start job instruction is input, the printer 1 drives the main driving roller 24*a* of the transport roller pair 24 to apply the transport force to the medium M, thereby moving the medium M to the lower portion of the printing unit 3. In this case, in the platen heater unit 42, heating sources (the heater 42*a* and the heater 42*b*) are driven, and the temperature of the platen 51 is raised from the normal temperature to a predetermined temperature (in the embodiment, for example, 40° C.). In the platen 51, the support face 50 is radiated and heated by the heater 42*b*, and the opposite face is heat-transferred and heated by the heater 42*a*.

When the medium M is transported up to the printing area on the support face 50, the printer 1 starts printing by the ink jet head 31. In this case, the support face 50 of the platen 51 is covered by the medium M, and thus it is difficult to receive the heat from the heater 42*b*. However, the heat caused by the heater 42*a* is received, thereby keeping the temperature constant.

The ink jet head 31 is mounted on the carriage 32, and performs printing while reciprocating in the width direction. The heater 42*b* is provided over the upside of the carriage 32 in the width direction. Accordingly, when the carriage 32 is retreated from the ink landing area, the ink landing area is directly radiated and heated at a wavelength in which a main part of a peak of a radiation spectrum includes an area of 2 μm to 4 μm. Accordingly, the water molecules included in the landing ink vibrate, evaporation drying is promoted by the friction heat, and the ink is fixed without causing blur or the like on the medium M.

When a printing end job instruction is input, the driving of the heating sources (the heaters 42*a* and 42*b*) is stopped in the platen heater unit 42, and the temperature of the platen 51 is dropped from a predetermined temperature to the normal temperature.

In the roll body R in which the medium M is wound on the support shaft R1 as described in the embodiment, the end of the medium M is rarely attached to the support shaft R1. When the medium M is attached as described above, the medium M may not be satisfactorily transported to the lower portion of the printing unit 3.

In this case, it is difficult to detect the end portion of the medium M by the end detecting sensor 80. Then, the ink is continuously ejected on the medium M, which is not transported (not moved), from the ink jet head 31 of the printing unit 3, and there may be a problem that the inside of the printer 1 is contaminated by ink which cannot be kept by the medium M.

On the contrary, in the printer 1 according to the embodiment, at the time of transporting the medium by the transport unit 2, the control unit 40 performs a determination process of determining (detecting) the transport abnormality caused by the attachment of the medium M described above.

Figure 6:
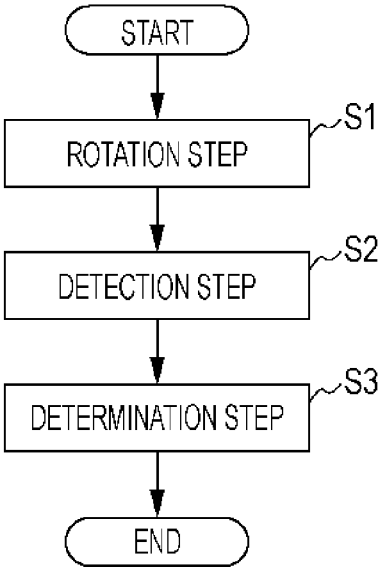
FIG. 6 is a diagram illustrating a determination process according to the embodiment.
Figure 7A:
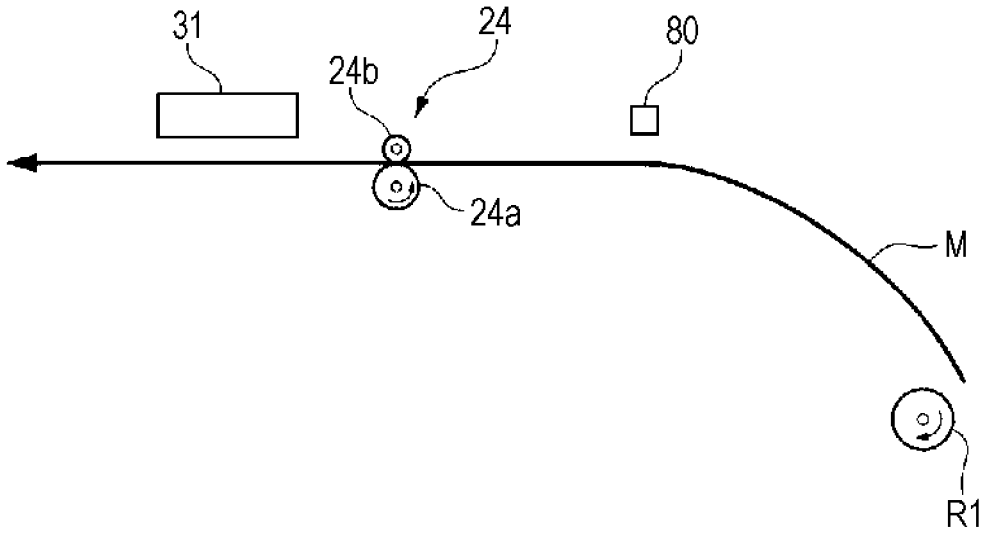
FIG. 7A and FIG. 7B are diagrams illustrating a medium and a support shaft state in the determination process.
Figure 7B:
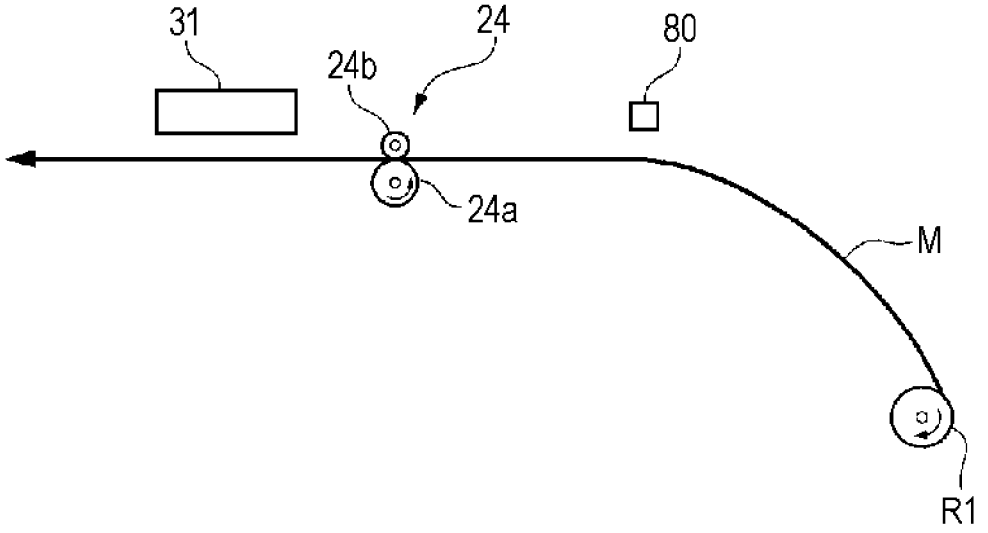

Hereinafter, the determination process at the time of transport of the medium M will be described. FIG. 6 is a diagram illustrating the determination process. FIG. 7A and FIG. 7B are diagrams illustrating a state of the medium M and the support shaft R1. When the medium M is being normally transported, the control unit 40 detects the rotation of the main driving roller 24*a* and the rotation of the support shaft R1 rotated by the transport of the medium M. The determination process includes a rotation step S1, a detection step S2, and a determination step S3.

In the rotation step S1, when the rotation of the support shaft R1 is not detected in the state where the transport operation of the medium M is performed, the control unit 40 rotates the support shaft R1 using the roll driving unit 61. The control unit 40 does not perform the determination step as follows, as long as the rotation of the support shaft R1 is detected in the state where the transport operation of the medium M is performed.

Herein, a case where the rotation of the support shaft R1 is not detected in the state where the transport operation of the medium M is performed is considered in the following two cases. First, as shown in FIG. 7A, it is a state where the medium M of the roll body R is completed. When the medium M disappears and the medium M deviates from the support shaft R1, the rotation force is not applied to the support shaft R1, and the support shaft R1 is not rotated. For this reason, the roll rotation detecting unit 64*b* does not receive the light passing through the disc-shaped scale 64*a* provided integrally with the support shaft R1, and the control unit 40 does not receives the signal representing the rotation of the support shaft R1 from the roll rotation detecting unit 64.

Secondarily, as shown in FIG. 7B, it is a state where the end portion of the medium M is attached to the support shaft R. When the medium M is attached to the support shaft R1, slip occurs between the main driving roller 24*a* and the driven roller 24*b*, the medium M is not moved, and thus the support shaft of the roll body R is not rotated. For this reason, the control unit 40 does not receive the signal representing the rotation of the support shaft R1 from the roll rotation detecting unit 64.

As described above, when the rotation of the support shaft R1 is not detected, the control unit 40 rotates the support shaft R1. Specifically, in the embodiment, the control unit 40 drives the motor 62 of the roll driving unit 61 to rotate the support shaft R1 by the rotation of the motor 62. It is preferable that the rotation direction of the support shaft R1 be set to be opposite to the transport direction of the medium M. This is because, when the medium M is attached to the support shaft R1 as described above, the movement of the medium M is regulated in the case of rotating the medium M in the winding direction (the opposite direction to the transport direction of the medium M) as compared with the case of rotating the medium M in the unwinding direction, and it is easy to detect whether or not the support shaft R1 is momentarily rotated.

Subsequently, the control unit 40 performs the detection step S2 of detecting the rotation of the support shaft R1.

When the cause of why the rotation of the support shaft R1 is not detected is the completion (see FIG. 7A) of the medium M in the roll body R, the support shaft R1 is rotated as shown in FIG. 7A. When the support shaft R1 is rotated, the disc-shaped scale 64*a* is also rotated. Accordingly, the control unit 40 receives the signal representing the rotation of the support shaft R1 from the roll rotation detecting unit 64. Accordingly, the control unit 40 detects the rotation of the support shaft R1. In this case, the control unit 70 determines that the transport state of the medium M is normal.

Meanwhile, when the reason why the rotation of the support shaft R1 is not detect is caused by the attachment (see FIG. 7B) of the medium M, the support shaft R1 is in the state of being pulled to the medium M and thus is not rotated as shown in FIG. 7B. When the support shaft R1 is not rotated, the disc-shaped scale 64*a* is also not rotated. Accordingly, the control unit 40 does not receive the signal representing the rotation of the support shaft R1 from the roll rotation detecting unit. Accordingly, the control unit 40 detects that the support shaft R1 is not rotated.

Subsequently, the control unit 40 performs the determination step S3 of determining the abnormality of the transport state of the medium M on the basis of the detection result of the detection step S2. When the main driving roller 24*a* is in the rotating state (medium transport state) but the support shaft R1 is not rotated as described above, the control unit 40 may determine that the medium M is attached to the support shaft R1. Meanwhile, when the main driving roller 24*a* is in the rotating state (medium transport state) but the support shaft R1 is rotated as described above, the control unit 40 may determine that the medium M of the roll body R is completed.

The control unit 40 determines that the transport state of the medium M is abnormal at the time point of detecting the attachment of the rear end of the medium M to the support shaft R1, and stops the printing process performed by the printing unit 3 at this time point. Accordingly, it is possible to prevent the inconvenience from occurring, in which the ink is continuously ejected onto the medium M in the transport failure from the ink jet head 31 of the printing head 3 to contaminate the inside of the printer 1.

Meanwhile, when the control unit 40 determines that the medium M of the roll body R is completed, the control unit 40 determines that the transport state of the medium M is normal, detects the end portion of the medium M by the end detecting sensor 80, considers the remaining amount of the medium M, and then performs the printing process using the printing unit 3. Accordingly, it is possible to perform the printing process such that the margin of the back end of the medium M is made as small as possible, and thus it is possible to fully use the medium M without waste.

As described above, according to the embodiment, in the transport process of the medium M in which the transport unit 2 starts winding from the roll body R to transport the medium M to the printing unit 3, it is possible to determine abnormality of the transport state of the medium M, and thus it is possible to stop the transport operation of the medium M even when it is difficult to detect the rear end of the medium M by the end detecting sensor 80. Accordingly, for example, when the printer 1 is driven by night unmanned driving and even when the transport abnormality of the medium M occurs, it is possible to prevent the ink from being continuously ejected to the medium M in the transport abnormal state and it is thereby possible to prevent the inside of the printer 1 from being contaminated. The rear end of the medium M is detected by the end detecting sensor 80, and thus it is possible to use the medium M of the roll body R fully, without waste.

The preferred embodiment of the invention has been described with reference to the drawings, but the invention is not limited to the embodiment described above. Various shapes and combinations of the constituent members represented in the embodiment described above are examples, and may be variously modified on the basis of design requirement in the scope which does not deviate from the main concept of the invention.

For example, in the embodiment, a case where the control unit determines abnormality of the transport state caused when the end of the medium is attached to the support shaft R1 in the roll body R has been described as an example, but the invention is not limited thereto. For example, the control unit 40 may determine the abnormality of the transport state where it is difficult to satisfactorily transport the medium M to the printing unit 3 since the mediums M are attached to each other in the way of the roll body R. In such a case, the main driving roller 24*a* is rotated to apply transport force to the medium M, but the attached medium M is not transported, and thus the medium M is not unwound from the roll body R. Accordingly, the roll body R (support shaft R1) is not rotated. Therefore, although the control unit 40 detects the rotation of the main driving roller 24*a*, the control unit 40 may determine the abnormality of the transport state as occurrence of the attachment of the medium M as described above in the state where it is difficult to detect the rotation of the support shaft R1.

In the embodiment, a case where the printing apparatus is the printer 1 has been described as an example, but the printing apparatus is not limited to the printer, and may be an apparatus such as a copy machine or a facsimile.

As the printing apparatus, a printing apparatus that ejects or sends fluid other than ink may be employed. For example, the invention is advantageous for various kinds of printing apparatuses provided with a printing head ejecting a small amount of liquid droplets. The liquid droplets represent liquid ejected from the printing apparatus, and include granularity, moistness, and yarn. The liquid described herein is preferably a material which can be ejected by the printing apparatus. For example, the material preferably is liquid, and includes a liquid body with high or low viscosity, sol, gel water, fluid such as inorganic solvent, organic solvent, solvent, liquid resin, and liquid metal (molten metal), and a material in which functional material particles formed of a solid material such as pigments and metal particles are dissolved, dispersed, or mixed with a solvent, as well as the liquid as one state of the material. A representative example of the liquid may be the ink described in the embodiment. Herein, the ink includes various kinds of liquid compositions such as general aqueous ink, oily ink, gel ink, and hot-melt ink. The printing medium includes a plastic film such as a vinyl chloride film, a sheet, a functional sheet, a board, and a metal plate.

The entire disclosure of Japanese Patent Application No. 2011-154509, filed Jul. 13, 2011 is expressly incorporated by reference herein.

What is claimed is:

1. A roll-shaped medium transport device that transports a roll-shaped medium past a printing unit, the roll-shaped medium transport device comprising:

a medium supply unit that keeps a roll body, that includes the roll-shaped medium wound on a support shaft, and unwinds and supplies the roll-shaped medium to a winding unit;

a winding unit that receives the roll-shaped medium from the medium supply unit, wherein the winding unit is downstream of the printing unit and wherein the winding unit winds the medium to form a roll body;

a pair of transport rollers that transports the roll-shaped medium unwound from the roll body along a transport path towards the printing unit and to the winding unit;

a rotation detecting unit that detects rotation of the support shaft of the medium supply unit;

a rotation unit that rotates the support shaft of the medium supply unit;

an end detecting unit that is separate from the rotation detecting unit and that is disposed between the medium supply unit and the pair of transport rollers unit, and upstream of the printing unit, and detects an end of the roll-shaped medium; and a determination unit that determines an abnormality of a transport state of the roll-shaped medium, the determination unit configured to:

cause the rotation detecting unit to detect that the support shaft is rotating when a transport operation of the roll-shaped medium is performed;

cause the rotation unit to rotate the support shaft when the rotation detecting unit detects that the support shaft has stopped rotating after previously rotating during the transport operation of the roll-shaped medium; and determine the abnormality on the basis of a detection result of the rotation detecting unit when the rotation unit rotates the support shaft, wherein the determination unit determines that the roll-shaped medium of the roll body is ended when the end detecting unit detects the end of the roll-shaped medium, when the rotation of the support shaft is detected by the rotation detecting unit.

2. The roll-shaped medium transport device according to claim 1, wherein the determination unit determines that the transport state of the roll-shaped medium is normal when the rotation of the support shaft is detected by the rotation detecting unit.

3. The roll-shaped medium transport device according to claim 1, wherein the rotation unit rotates the support shaft in a direction opposite to a transport direction of the roll-shaped medium.

4. A printing apparatus comprising:

the roll-shaped medium transport device according to claim 1; and a printing unit that performs a printing process on the roll-shaped medium supplied to the roll-shaped medium transport device, wherein the transport of the roll-shaped medium and the printing process performed by the printing unit are stopped when the determination unit determines that the transport state of the roll-shaped medium is abnormal.

5. A roll-shaped medium transport method of transporting a roll-shaped medium wound out from a roll body formed by winding the roll-shaped medium on a support shaft, past a printing unit, the method comprising:

detecting by a rotation detecting unit that the support shaft of a medium supply unit is rotating during a transport operation of the roll-shaped medium, the transport operation transporting the roll-shaped medium from the medium supply unit that keeps the roll body to a winding unit, the roll-shaped medium being transported along the transport path from the medium supply unit, which keeps the roll body, through a pair of transport rollers to the winding unit, and past the printing unit, wherein the printing unit is upstream of the winding unit and downstream of the medium supply unit and wherein the winding unit rolls up the medium to form a roll body, rotating the support shaft using a rotation unit when rotation of the support shaft is not detected after the support shaft has previously rotated during the transport operation of the roll-shaped medium, detecting the rotation of the support shaft caused by the rotation unit, determining an abnormality of a transport state of the roll-shaped medium on the basis of a detection result of the detection, detecting by an end detecting unit, that is separate from the rotation detecting unit and disposed between the medium supply unit and the pair of transport rollers, and upstream of the printing unit, an end of the roll-shaped medium, when the rotation of the support shaft is detected by the rotation detecting unit; and determining that the roll-shaped medium of the roll body is ended when the end detecting unit detects the end of the roll-shaped medium.

* * * * *